US005282534A

United States Patent [19]

Lapp

[11] Patent Number: 5,282,534

[45] Date of Patent: Feb. 1, 1994

[54] COMBINED PRODUCT PACKAGE AND COUPON DELIVERY SYSTEM

[76] Inventor: James F. Lapp, 1703 Park Ave., Richmond, Va. 23230

[21] Appl. No.: 860,073

[22] Filed: Mar. 30, 1992

[51] Int. Cl.[5] ..... B65D 71/00

[52] U.S. Cl. ..... 206/232; 206/459.5; 206/831; 229/2.5 EC; 53/445

[58] Field of Search ..... 206/217, 232, 459, 831, 206/521.1; 229/2.5 EC, 921; 53/445; 40/310, 311, 312, 313

[56] References Cited

U.S. PATENT DOCUMENTS

| | | | |
|---|---|---|---|
| 1,657,391 | 1/1923 | Haney | 206/831 |
| 1,686,354 | 10/1928 | Wallace | 206/831 |
| 1,798,339 | 3/1931 | Soulis | 206/217 |
| 2,054,596 | 9/1936 | Ford | 40/312 |
| 2,600,130 | 6/1952 | Schilling | 229/2.5 EC |
| 3,147,856 | 9/1964 | Lightner et al. | 206/831 |
| 3,199,769 | 8/1965 | Hillman, II et al. | 206/831 |
| 3,211,470 | 10/1965 | Wilson | 40/310 |
| 3,373,045 | 3/1968 | Peterson | 40/312 |
| 3,396,895 | 8/1968 | Pearl et al. | 229/2.5 EC |
| 3,695,422 | 10/1972 | Tripodi | 40/312 |
| 3,994,089 | 11/1976 | Schwartz | 40/310 |
| 4,181,219 | 1/1980 | Marion | 206/217 |
| 4,389,802 | 6/1983 | McLaren et al. | 40/311 |
| 4,699,311 | 10/1987 | Wallis | 206/831 |
| 4,767,654 | 8/1988 | Riggsbee | 40/310 |
| 4,923,702 | 5/1990 | Powell et al. | 206/217 |
| 5,035,515 | 7/1991 | Crossman et al. | 206/831 |
| 5,056,681 | 10/1991 | Howes | 206/831 |
| 5,076,433 | 12/1991 | Howes | 206/459 |

*Primary Examiner*—David T. Fidei

[57] ABSTRACT

A combined consumer product and discount coupon delivery package, such as an egg carton, having a shallow recess for containing a pack of coupons. The recess is covered by a label cover which has an integral openable access panel to expose the coupons and permit their extraction.

13 Claims, 5 Drawing Sheets

COMBINED PRODUCT PACKAGE AND COUPON DELIVERY SYSTEM

This invention relates to a package for consumer merchandise that includes an integral coupon or other printed material contained in a shallow well covered by a label. The label cover has an integral access panel for removing the coupons from the shallow well.

BACKGROUND OF THE INVENTION

Coupons are a widely used sales building tool for consumer products or services. These coupons generally give a reduction in price, or are redeemable for part of the purchase price and/or offer free samples. In 1990, 276 billion coupons were distributed in the United States. The coupons were redeemed at a value of $3.5 billion but redemptions represented only 2½% of those issued.

Coupons are distributed through high volume channels by mail, in products, on product packages, on pages in publications and newspapers, and as free-standing inserts (FSI). The most common distribution channel is the Sunday newspaper by FSIs which accounts for over 50% of all coupons issued and 70% of all redemptions. A growing problem is the mis-redemption of coupons. Mis-redemption problems include allowing redemption without purchase (64%) and discount allowed for the wrong product (19%) resulting in an accumulated cost estimated to be $315 million annually because of mis-redemptions.

SUMMARY OF THE INVENTION

The present invention represents a different and more effective means of couponing and processing. The present invention offers the advertiser a high volume exposure at a point of sale with discount coupons which can be immediately used in the store in which they are obtained. The coupons may be distributed with a unique number which allows for the development of demographic marketing data and also protection for the manufacturer from mis-redemption.

The coupons or other printed material are assembled together such as five individual, double sided coupons, printed on white offset paper, and perforated for easy removal after being bound in a checkbook size unit. The multiple pages can be formed by folding or by gathering together and being stapled or glued at one end or both ends. Each coupon preferably is uniquely numbered to provide a potential demographic tie to the store and the consumer. The coupon pack is laid in a shallow well formed on the surface of a container for consumer products which is preferably a modified typical egg carton. The shallow recess is surrounded by a frame which defines a mounting area for a combined label and cover which overlaps the shallow recess or well and is attached to the mounting area preferably by pressure sensitive adhesive.

The combined label and cover has normal printed material on its surface and serves to form a cover for the shallow recess. The label cover has an access panel integral therewith which may be opened to expose part of the shallow recess and the thin pack of coupons so that they can be removed and utilized.

While the invention may be used with any suitable container for consumer products, it is especially useable with egg cartons due to their high unit volumes. Egg cartons are ideal for distributing coupons for products which relate to eggs such as breakfast or baking products, pre-prepared diet meals, coffee etc.

DESCRIPTION OF THE PREFERRED EMBODIMENT

In this description, including the accompanying drawings, there is shown and described a preferred embodiment of the invention. Others skilled in the art will understand the invention and the principles thereof and will be able to modify the preferred embodiment and embody the invention in a variety of forms, each as may be suited for the conditions of a particular case.

BRIEF DESCRIPTION OF THE DRAWINGS

With reference to FIGS. 1 and 2 there is shown an egg carton 10 of a typical design to hold a dozen eggs in individual compartments 12. The egg carton is of the clam shell type which opens from the front along girth line 14 which is hinged at 16 in the rear. When the egg carton is opened the twelve eggs are exposed for easy withdrawal. The top cover of the egg carton 10 has six openings 18 therein connected by a longitudinal channel 20. As described so far, the egg carton 10 is like a standard egg carton but it could be a container for consumer products such as a milk carton, pill bottle, etc. designed for purchase by the consumer.

Figure 1:
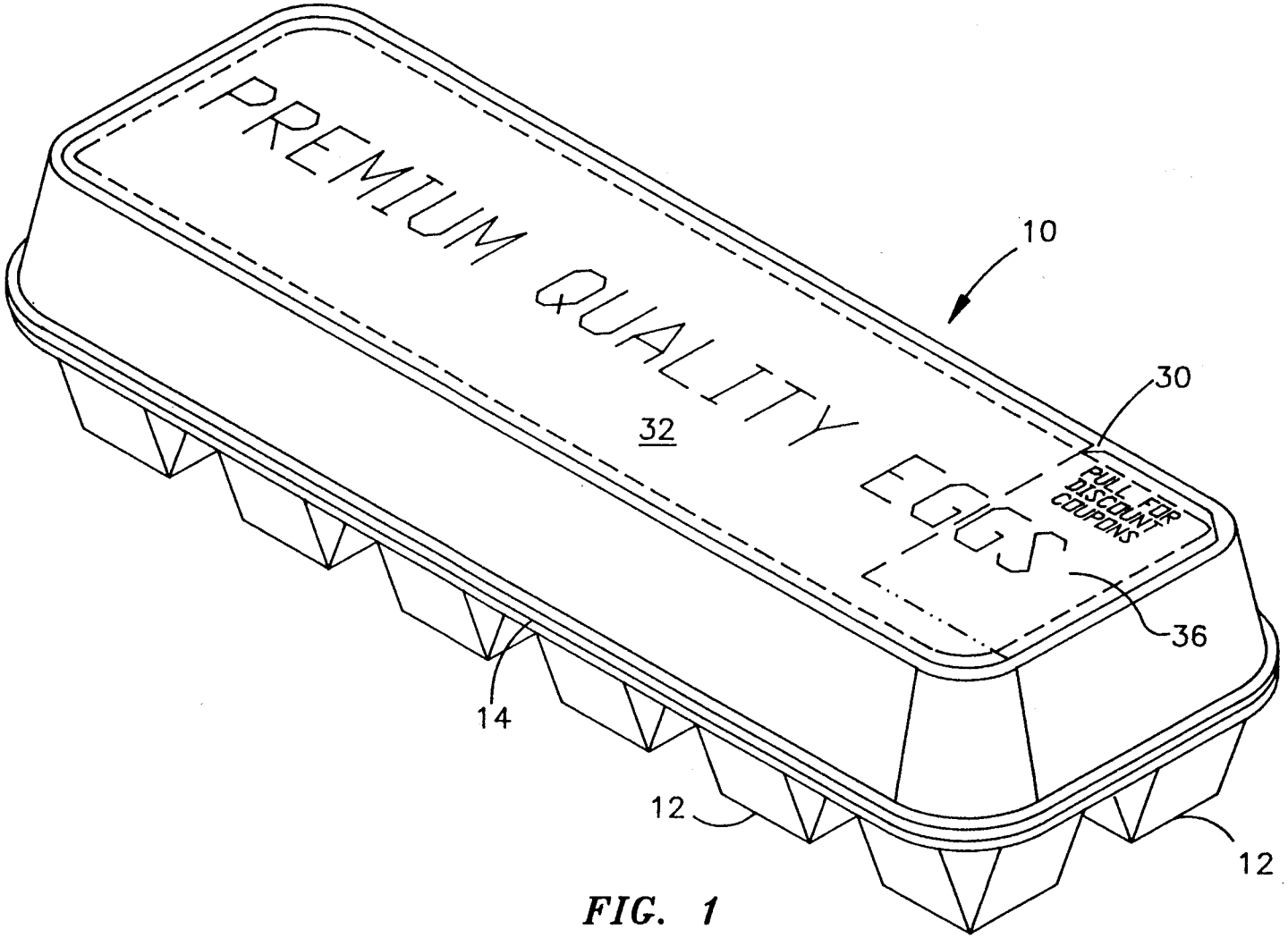
FIG.1 shows a perspective view of a closed egg carton having a shallow recess for discount coupons covered over by a combined label and cover.
Figure 2:
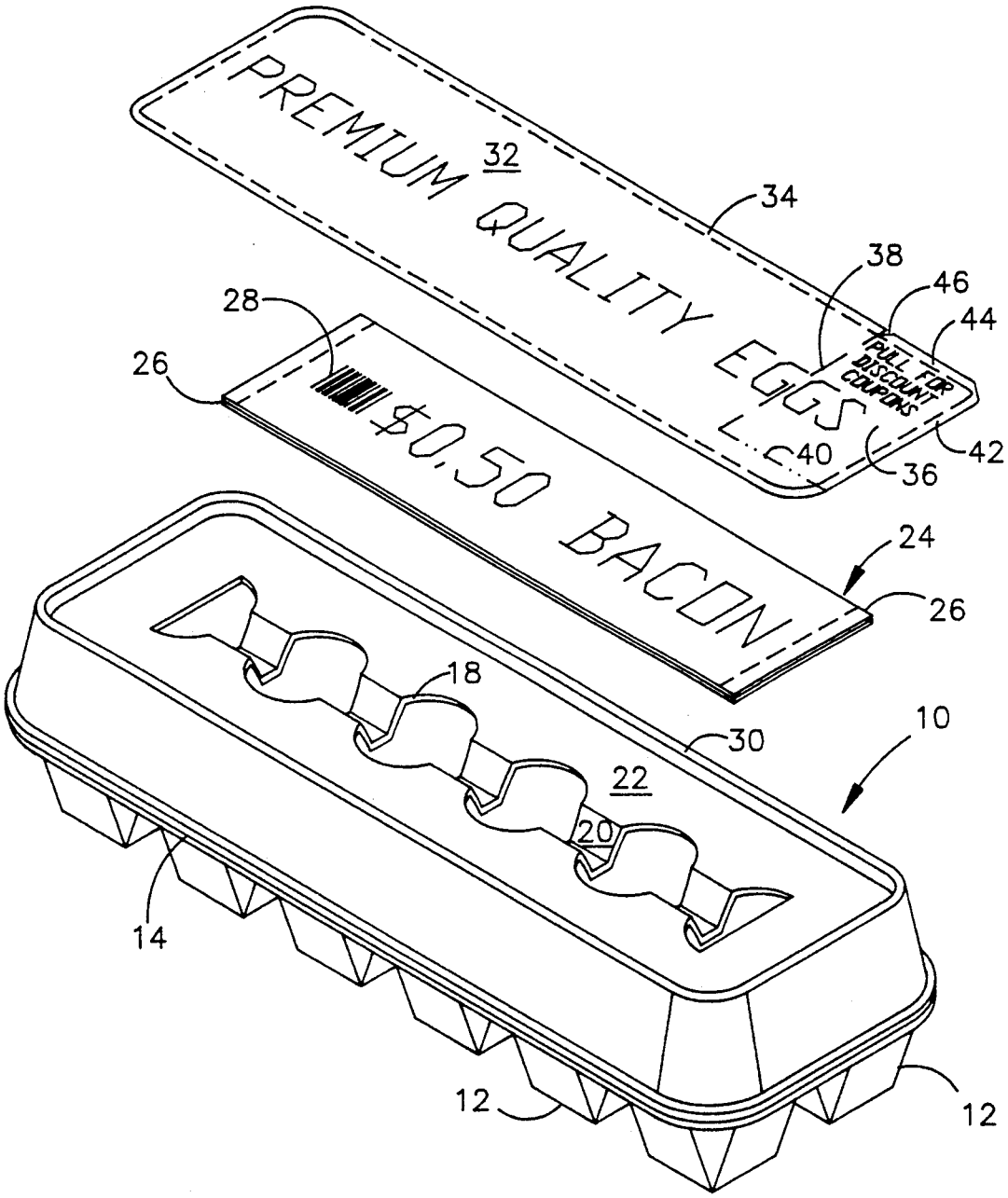
FIG. 2 is an exploded view of FIG. 1.

Such containers are modified for purposes of the present invention by having a shallow recess 22 which may be also referred to as a shallow well or shallow pocket on the exterior surface of the container. This shallow recess is embossed or molded or otherwise provided in the surface of the package or container preferably on a planar or flat surface but it may be along any developed surface that forms part of a cylinder or cone. The shallow well 22 has contained therein multiple pages of printed material 24 which preferably are a stack of four or five discount coupons. The discount coupons are fastened into a thin pack 24 by either being adhered, integrally connected or stapled at one of the short edges or as shown in FIG. 2, adhered at both of the short edges 26. Each coupon has printed thereon the normal information that would be on a discount coupon. It would also contain a standard UPC code 28 which also includes an individual serial number so as to identify the store the product was purchased in for purposes of market studies and helping to prevent the mis-redemption of coupons. Other identification codes than UPC may be used.

While preferably the discount coupons are held together in checkbook fashion, they may be in a form of a larger sheet folded to fit into the shallow well 22. They preferably have information printed on the side opposite discount coupon information. It is to be noted that the underside of the coupon pack 24 may be viewed through the openings 18 of the egg carton when the egg carton is opened.

The coupon pack 24 extends almost the full length of the shallow well 22 and are also approximately of the same width. In the preferred embodiment, the shallow well 22 is approximately 10 $\frac{5}{8}$" long, $2\frac{7}{8}$" wide and 3/32" deep. The shallow well 22 is surrounded by or framed by a flat mounting area 30 which is approximately $\frac{1}{4}$" in width but may vary from approximately $\frac{1}{8}$" in width to a substantially larger width. The shallow well 22 may vary from approximately 1/16" to not more than $\frac{1}{2}$" deep.

A combined label and cover 32 referred to herein sometimes as label cover, is an important feature of the invention. The label cover is a flat material having printed information on its exposed outer surface and preferably a pattern of pressure sensitive adhesive 34 applied to the inside surface at the outer rim so as to adhere the label cover to the flat mounting area 30 of the egg carton. The pressure sensitive adhesive is preferably applied in a pattern that is approximately $\frac{1}{8}$" in width. Suitable pressure sensitive adhesives for patterned coating are readily available and known in the printing art and should be of a quality that will adhere the label cover to the egg carton but preferably permit it to be peeled away and resealed for purposes of which will be described infra. The pressure sensitive adhesive may be of any suitable formulation picked by the label printer but in the case of egg cartons it must be able to withstand the cold temperatures which are utilized in refrigeration and yet permit easy peel back and ability to refasten itself. Other suitable methods for adhering the label covers to the container may also be used.

The preferred label cover 32 shown is $10\frac{7}{8}$" long by $3\frac{1}{8}$" in width. The label cover has at one end an access panel 36 as an integral part of said label cover. The access panel cover 36 has instructions for opening and a perforation or score line 38 running approximately the full width of the label cover terminating at one end of an integral hinge 40 which is merely a fold line in the label cover. As shown in FIG. 2, the right side of the access panel 36 is adhered to the egg carton and may or may not be adhered in top area 44. The label cover may be of any suitable paper or plastic sheet but is preferably 20 pound coated paper sheet. It must be able to take the printing, be economical for use and be suitably strong to bridge and hold the contents in the shallow well.

Once a purchaser has bought the carton of eggs he or she may open the access panel 36 by putting a finger nail under the top portion of the access panel 36 and pulling downward. The original breaking of the perforations 38 is assisted by notch 46. As the access panel is pulled open, the peelable, pressure sensitive adhesive in area 42 is released and the perforations 38 are torn until the access panel is open and hinged along 40 to expose the discount coupons located in the shallow well 22. The access opening or panel opening is sufficiently large to permit the width of the pack of discount coupons to be withdrawn. The pack is approximately $9\frac{1}{2}$" long by $2\frac{3}{4}$" wide. The exposed panel should be slightly wider than $2\frac{3}{4}$". The access panel 36 can be reclosed and held in position by the pressure sensitive adhesive in area 42. As shown, pressure sensitive adhesive is also used in area 44 but it may be preferable to omit adhesive from that area to permit more ready opening of the access panel.

Figure 3B:
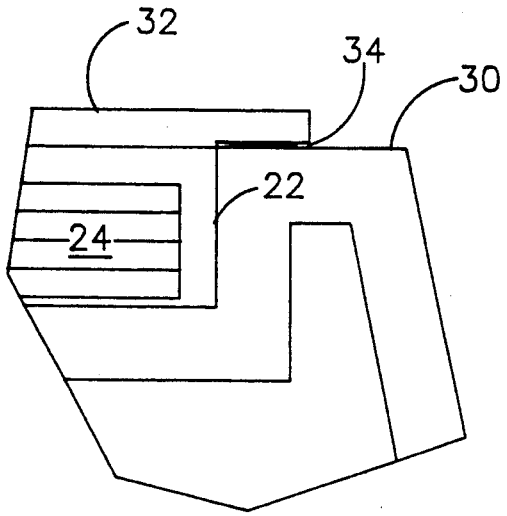
FIG. 3B shows a part of the section of FIG. 3A enlarged.
Figure 3A:
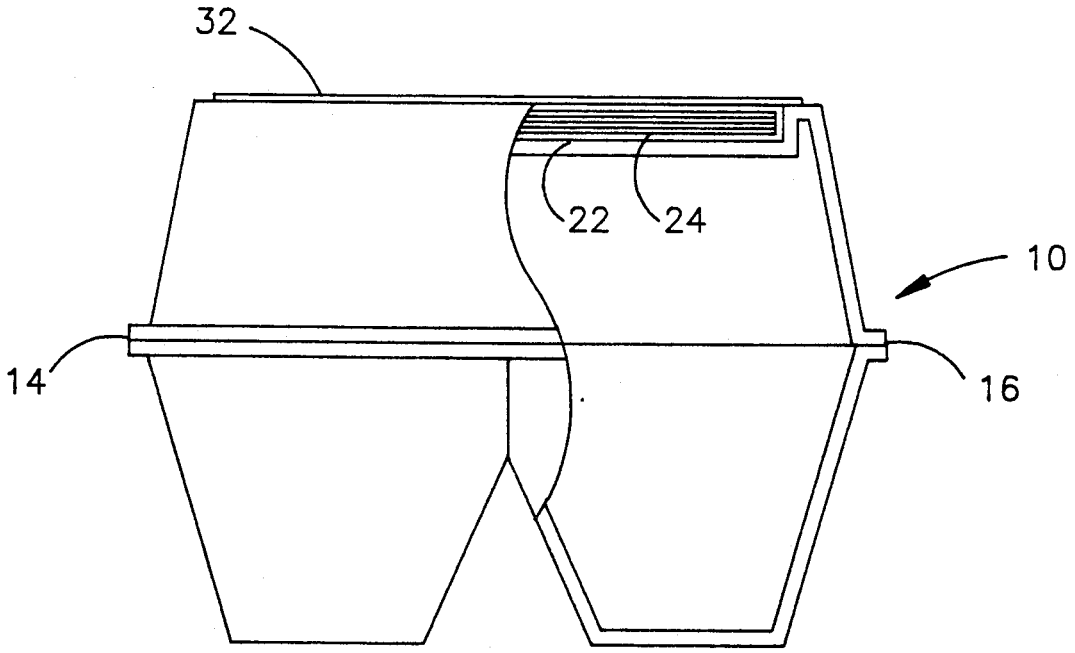
FIG. 3A, is an end view the Egg Carton of FIG. 1 with part of the container shown in section.
Figure 4B:
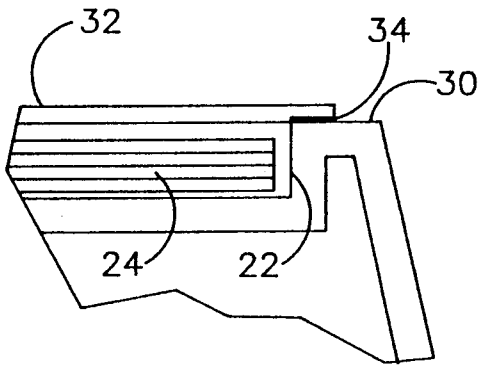
FIG. 4B shows an enlarged view of a corner portion of FIG. 4A.
Figure 4A:
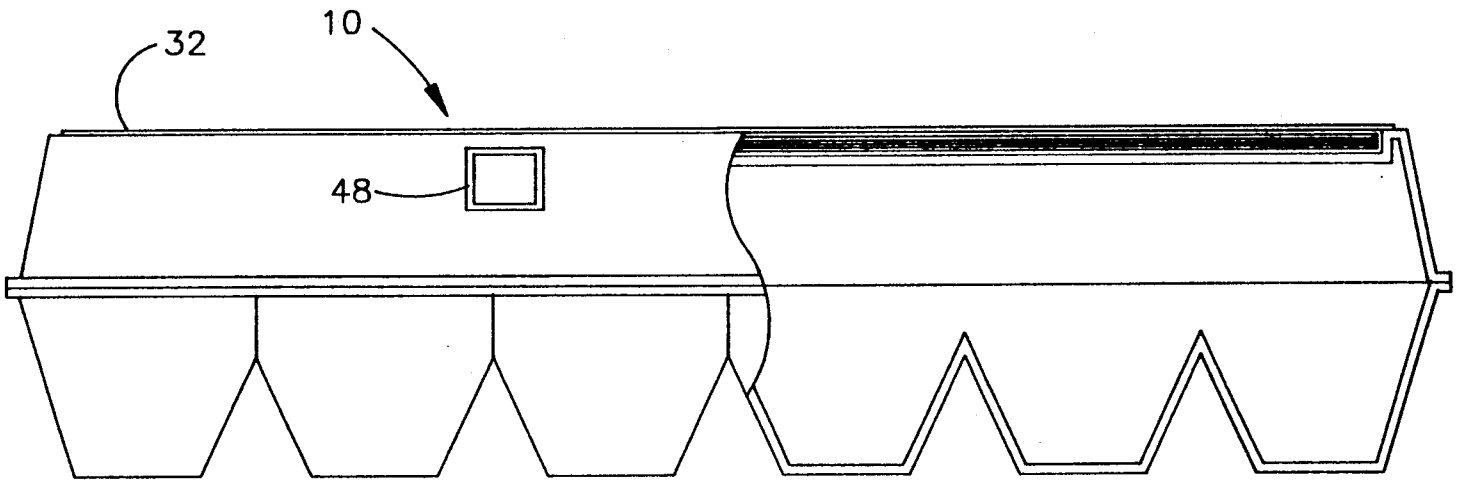
FIG. 4A is a view similar to FIG. 3A except it is a front view rather than a side view.

With reference to FIGS. 3 and 4 which are end views and front views of the egg carton, respectively, there is shown an exaggerated and more clearly shown view of the shallow well discount coupon pack 24, label cover 32, pressure sensitive adhesive 34, and mounting area 30 of the egg carton. Also, in FIG. 4 a locking lug 48 which is commonly used in egg cartons is also shown but omitted from the other figures.

Figure 5:
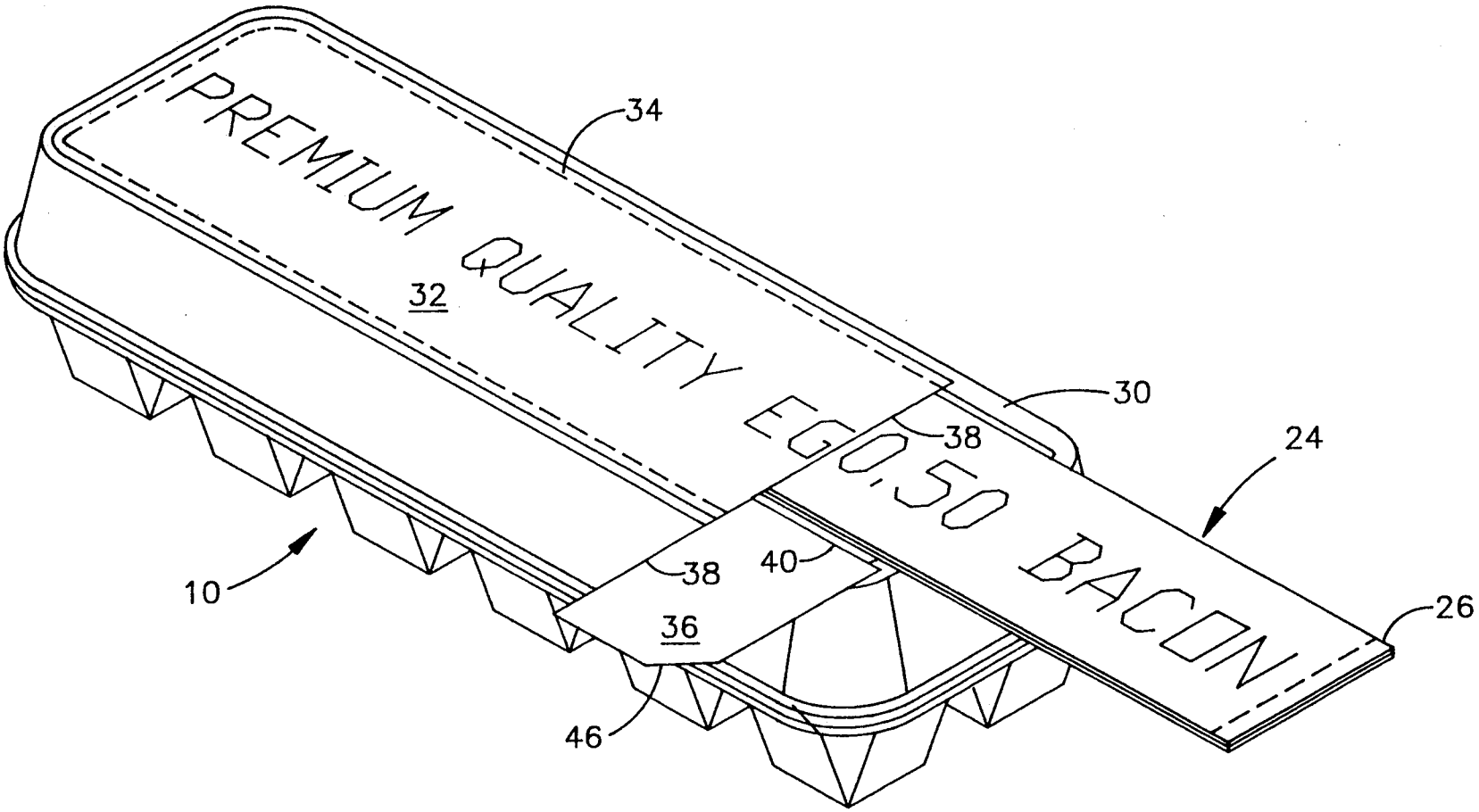
FIG. 5 is a view similar to FIG. 1 with the access panel of the label and cover opened along its hinge and the coupon pack partially extracted.

With reference to FIG. 5 the external access panel 36 is shown in its open position pivoted around integral hinge 40 with the pack of discount coupons 24 partially extracted through the opening provided by the access panel.

The invention disclosed herein fulfills a significant advance in consumer packages and combined delivery of discount coupons or other printed material in an economical and readily used form. It lends itself to giving a high volume exposure at a point of sale distribution of coupons of related products which can be immediately used in the store if desired. Also, the invention lends itself to having an individual numbering system associated with the coupons which provides an audit trail for obtaining demographic market data and reducing mis-redemption of the coupons.

It is to be understood that the following claims are intended to cover all of the generic and specific features of the invention herein described and it is to be understood that this specific embodiment herein shown is not to be construed in the limiting sense but is merely to depict and illustrate the principles of the present invention. Modifications may be devised by those with skill in the art which will not depart from the spirit or scope of protection as set forth in the following claims.

What is claimed is:

1. A combined product and printed material delivery package comprising:

an egg carton of the clam shell type heavy individual compartments to hold a multiplicity of eggs and having an outside surface visible when the container is in its normal position;

a substantially flat shallow recess in said surface framed by a mounting area;

a label cover having an access panel integral therewith overlapping and covering said shallow recess with said label cover having an outside surface and an inside surface with said outside surface having printed material thereon and said inside surface having its periphery mounted to said mounting area; and a thin pack of multiple printed pages contained in said recess and covered by said label cover which pages are accessible through an opening initially closed by said access panel and removable.

2. The package of claim 1 wherein said access panel is located at one end of said label cover and held at least partially thereto by a weakened line of a length at least equal to the width of said thin pack.

3. The package of claim 1 wherein said access panel has along one side thereof an integral hinge about which said access panel opens.

4. The package of claim 1 wherein said access panel is held to said mounting area at least along one side thereof with a peelable pressure sensitive adhesive.

5. The package of claim 1 wherein said shallow recess is between about 1/16" and about $\frac{1}{2}$" deep.

6. The package of claim 1 wherein said label cover has a pattern of pressure sensitive adhesive on said periphery of said inside surface for mounting to said mounting area.

7. The package of claim 6 wherein said access panel is located at one end of said label cover and held at least partially thereto by a weakened line of a length at least equal to the width of said thin pack.

8. The package of claim 6 wherein said access panel has along one side thereon an integral hinge about which said access panel opens.

9. The package of claim 6 wherein said access panel is held to said mounting area at least along one side thereof with a peelable pressure sensitive adhesive.

10. The package of claim 9 wherein said shallow recess has openings therein so that the underside of said coupon can be seen through said opening when the container is open.

11. The package of claim 9 wherein said coupons include an identification number.

12. The package of claim 9 wherein said thin pack of coupons are fastened together at one end thereof.

13. A method of simultaneously providing a consumer with eggs and discount coupons including the following steps:

providing an egg carton of the clam shell type having individual compartments to hold a multiplicity of eggs having a flat top with a shallow recess framed by a mounting area;

placing multiple discount coupons in said shallow recess;

covering said shallow recess by a label cover having printing thereon;

adhering said label cover at its periphery to said mounting area; and providing an access panel at one end of said label cover and integral therewith which is openable to expose said coupons and permit their extraction.

* * * * *